United States Patent [19]

Morris et al.

[11] 4,084,932

[45] Apr. 18, 1978

[54] ISOSTATIC MOLD APPARATUS

[75] Inventors: Kenneth John Morris, Cheveley Park Estate; Jan Salovsky, Sunderland, both of England

[73] Assignee: Olin Energy Systems, Ltd., Sunderland, England

[21] Appl. No.: 796,571

[22] Filed: May 13, 1977

[30] Foreign Application Priority Data

May 20, 1976 United Kingdom ..... 20934/76

[51] Int. Cl.[2] ..... B30B 5/02; B30B 11/00

[52] U.S. Cl. ..... 425/405 H; 425/418

[58] Field of Search ..... 425/405 H, 418

[56] References Cited

U.S. PATENT DOCUMENTS

| | | | |
|---|---|---|---|
| 2,091,973 | 9/1937 | Fessler et al. | 425/405 H X |
| 3,172,153 | 3/1965 | Loomis et al. | 425/405 H X |
| 3,618,164 | 11/1971 | Rietmann | 425/405 H X |
| 3,820,934 | 6/1974 | Stigler | 425/405 H X |
| 3,867,077 | 2/1975 | Deprez | 425/405 H X |

*Primary Examiner*—J. Howard Flint, Jr.

*Attorney, Agent, or Firm*—William W. Jones; Paul J. Lerner

[57] ABSTRACT

An improved mandrel assembly construction for use in an isostatic press. The compacted body is pressed onto the mandrel and an improved assembly is utilized to free the body from the mandrel and remove the body from the tooling so that the body can be subjected to further processing. A pressure intensifier is used to apply pressure to the mold bodies and a separate air spring is used to return the pressure intensifier piston to its original position.

6 Claims, 6 Drawing Figures

ISOSTATIC MOLD APPARATUS

The invention relates to improvements in isostatic molding apparatus of the kind described and illustrated in British patent specification No. 1,383,395 and particularly to an improved mandrel assembly therefor.

British patent specification No. 1,383,395 describes and shows a mandrel assembly comprising a mandrel extending from a sleeve, the sleeve being mounted in a tube with the end of the sleeve and the end of the tube flush with one another, the mandrel assembly being so constructed that in operation, after a body has been molded onto the mandrel, the mandrel and sleeve are rotated together with respect to the tube to free the body from the mandrel and the sleeve while leaving the mandrel engaged in the body. The sleeve is subsequently moved relatively outwardly to detach the molded body from the end of the tube and allow it to fall away from the sleeve and the mandrel.

That patent discloses that the rotation and subsequent outward movement of the sleeve with respect to the tube can be effected by a pair of air springs and a rod longitudinally movable with respect to the sleeve and the mandrel. Rotation of the rod and subsequent abutment of the rod and the sleeve causes movement of the sleeve with respect to the mandrel, the sleeve movement being effected by longitudinal movement of the rod in a manifold housing which contains the air springs and a lower portion of which forms the tube. The manifold housing is moved upwardly away from a mold in which the molded body is molded onto the mandrel to cause an upper end of the rod to abut a member above the manifold housing to move the rod downwardly with respect to the manifold housing and effect the rotation of the mandrel and sleeve and the subsequent relative movement of the sleeve and the tube.

According to one aspect of this invention there is provided an isostatic molding apparatus including a mandrel assembly having a mandrel extending from a housing which in operation closes a mold. A sleeve is disposed around the mandrel where it leaves the housing, and means are included for moving the housing along the mandrel after molding to facilitate stripping of a molded body from the mandrel.

Preferably a portion of the housing surrounding the sleeve can only be moved a limited distance away from the mold compared with the remainder of the housing, whereby movement of the remainder of the housing beyond the limited distance causes relative axial movement of the portion of the housing with respect to the sleeve and the mandrel to remove the mandrel from the molded body.

Preferably the portion of the housing is coupled to a projection which, when the housing has been moved away from the mold the limited distance, contacts a stop to prevent further movement of the portion of the housing away from the mold. Continued movement away from the mold of the remainder of the housing causes movement of a piston in a cylinder containing compressed air, the pressure of the compressed air in the cylinder causing the portion of the housing and the remainder of the housing to move back into close proximity one with the other upon subsequent movement of the remainder of the housing towards the mold.

Advantageously the mandrel and the sleeve are coupled for rotation with a member so linked to a transverse shaft engaged with a cam track that movement of the housing away from the mold causes lateral movement of the transverse shaft and thereby rotation of the mandrel and sleeve with respect to the housing. Preferably such rotation is of the order of 12°.

Preferably the mold is disposed in a mold member which, in a molding position, is juxtaposed with the housing which closes the mold. The mold member and the housing are relatively so mounted and disposed that, subsequent to a molding operation, the housing and the mold member initially move together in the same direction away from the molding position. The mold member is then checked and the housing continues to move in the same direction to move away from the mold member. There is preferably a hydraulic fluid pressure intensifier provided between the mold member and a frame of the apparatus and also an air spring is provided to move the mold member initially from the molding position, the air spring being disposed separately from the pressure intensifier.

The invention is diagrammatically illustrated by way of example in the accompanying drawings in which.

Figure 1:
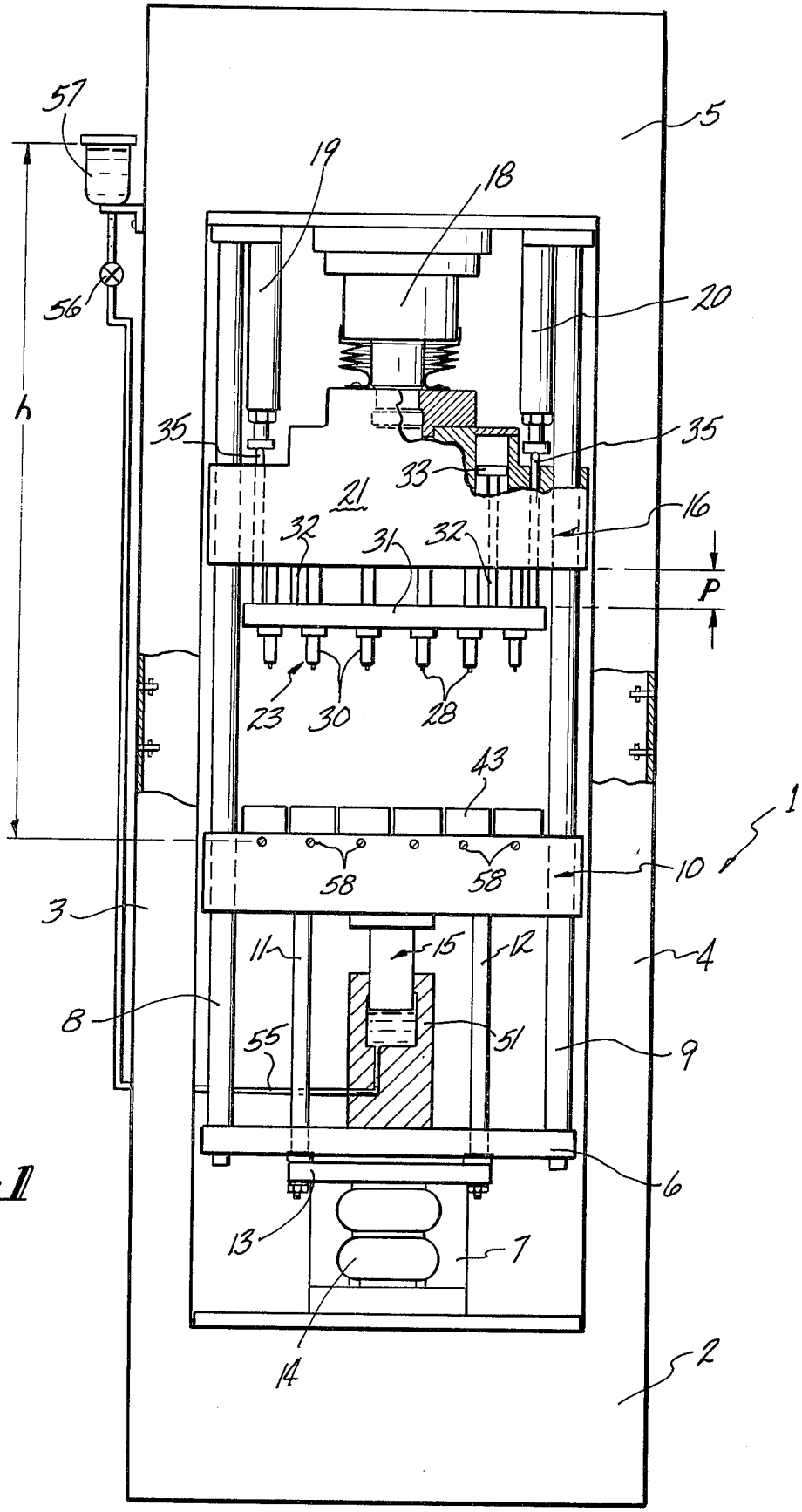
FIG. 1 shows an elevation of isostatic molding apparatus according to the invention.

Referring to the drawings and firstly to FIG. 1, the isostatic molding apparatus comprises a fixed frame 1 having a lower member 2, side members 3 and 4 and an upper member 5. A cross member 6 forms the upper part of a rigid pedestal 7 mounted on the lower member 2, and its ends support the lower ends of fixed columns 8 and 9. A lower bolster 10, containing molds, is slidable on the columns 8 and 9. Rods 11 and 12 are coupled to the lower bolster 10 and extend through apertures in the cross member 6 and are coupled to a cross member 13 below which, within the pedestal 7, is an air spring 14. A pressure intensifier 15 is provided between the cross member 6 of the pedestal 7 and the lower bolster 10.

An upper bolster 16 is also slidably mounted on the columns 8 and 9 and mounts a plurality of mandrel assemblies 23 each of which projects into a respective mold in the lower bolster 10 when the lower bolster 10 and upper bolster 16 are juxtaposed in a molding position. The upper bolster 16 is movable vertically on the columns 8 and 9 by a hydraulic piston-cylinder arrangement 18. Adjustable stops 19 and 20 are provided at either side of the piston-cylinder arrangement 18 and, like the piston-cylinder assembly 18, are secured to the upper member 5 of the frame 1.

Figure 2:
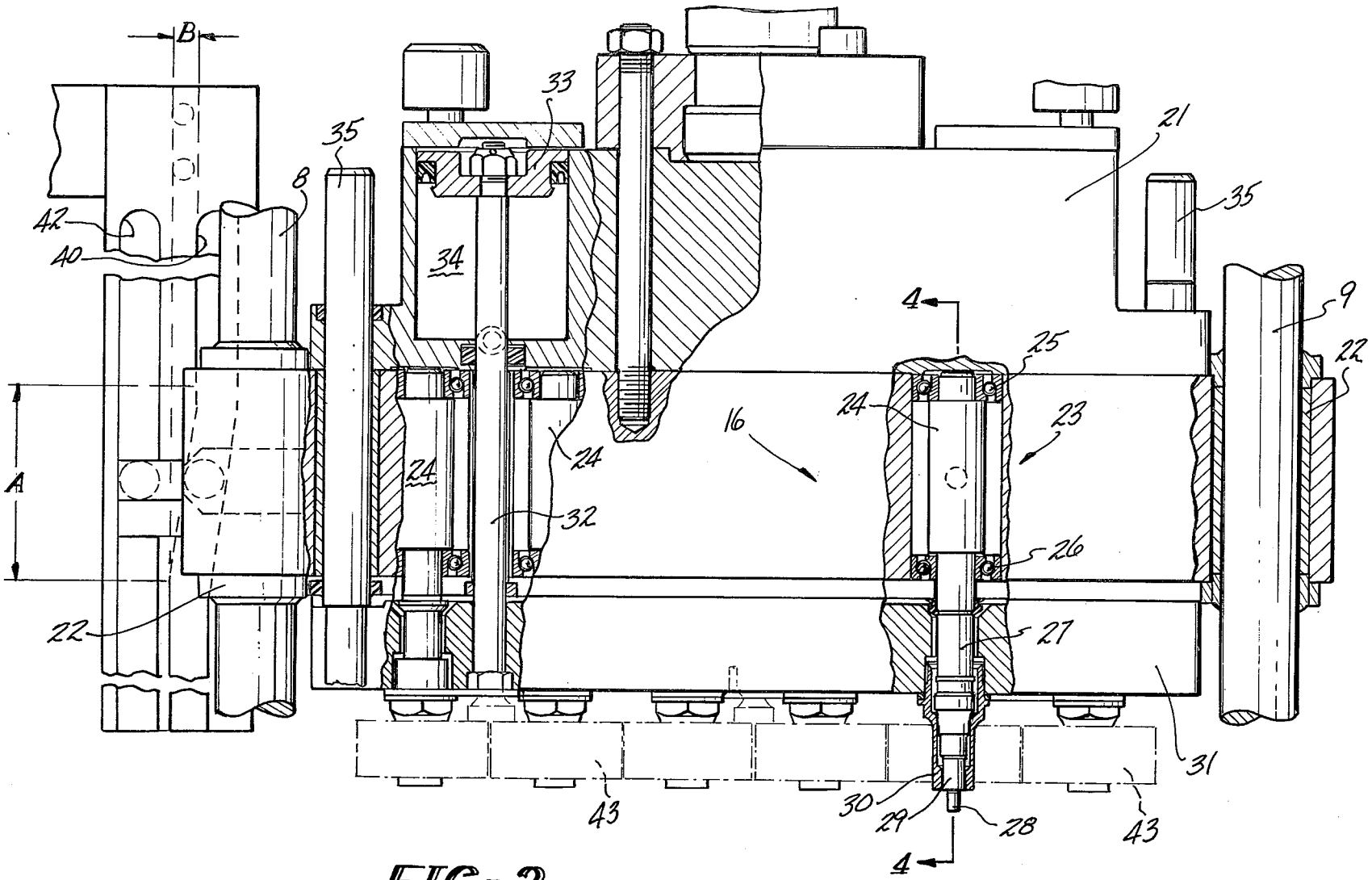
FIG. 2 is a part sectional elevation of an upper bolster of isostatic molding apparatus according to the invention.
Figure 3:
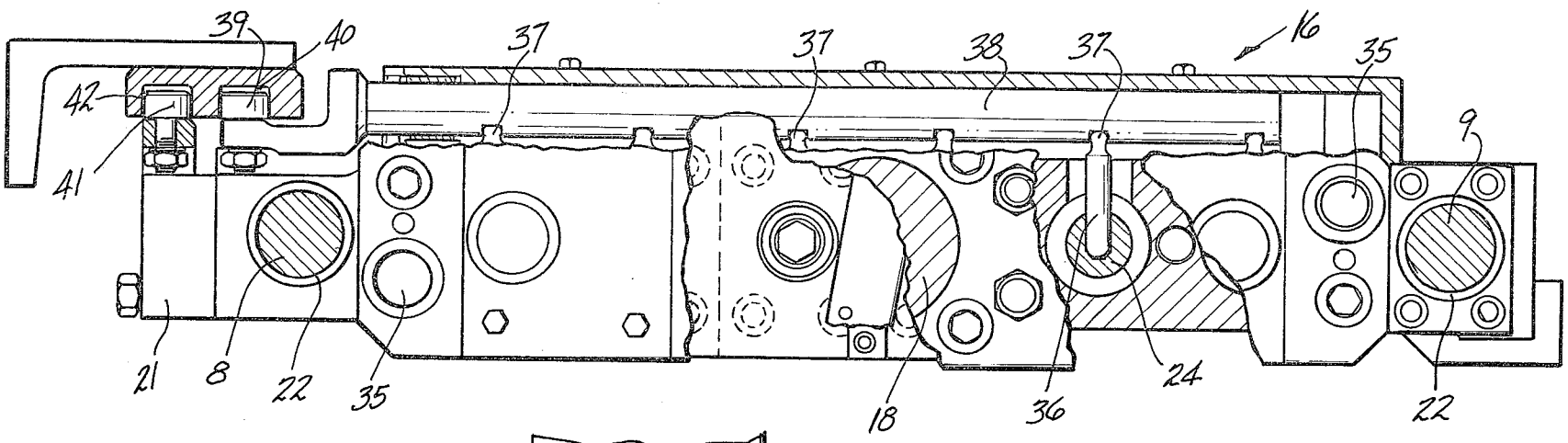
FIG. 3 is a partly sectioned plan view corresponding to FIG. 2.
Figure 4:
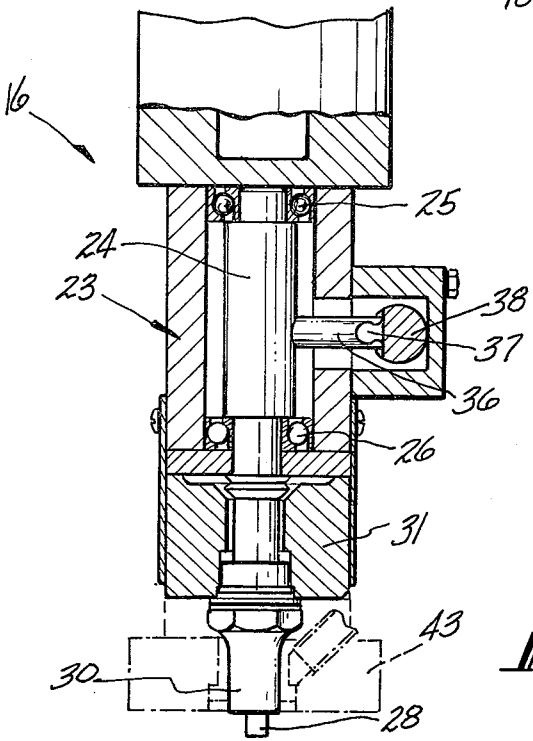
FIG. 4 is a sectional view taken on line 4—4 of FIG. 2.

FIGS. 2, 3, and 4 show the upper bolster member 16 in greater detail. The upper bolster member 16 comprises an upper housing portion 12 which mounts sleeves 22 whereby the upper bolster member 16 is slidably mounted on the columns 8 and 9 and is connected at its upper end to the piston-cylinder arrangement 18. A plurality, as shown six, mandrel assemblies 23 are rotatably but not axially movable in the upper housing portion 21. Each mandrel assembly comprises an upper journal 24 mounted on ball bearings 25 and 26, a downward extension 27 of the journal 24, which extension 27 mounts a mandrel 28 at its lower end. A sleeve assembly 29 surrounds the lower portion of the extension 27 and a tube 30 surrounds the sleeve 29 and has its lower end flush with the lower end of the sleeve 29, the mandrel 28 extending downwardly therefrom. The tube 30 is coupled to a lower housing portion 31 and the lower housing portion 31 is secured to the lower end of piston rods 32 (only one of which is shown in FIG. 2), the piston rods 32 each having a piston head 33 at the upper end mounted for sliding movement in a respective cylinder 34 provided in the upper housing portion 21. The cylinders 34 below the piston heads 33 are permanently coupled to a source of compressed air such that the piston heads and rods 32 are biassed to the upward position shown in FIG. 2. The lower housing portion 31 has a pair of guide rods 35 connected thereto, the guide rods 35 extending upwardly through bores in the upper housing member 21 and being so positioned that during the upward movement of the upper bolster 16 they abut the adjustable stops 19 and 20 (see FIG. 1).

As best shown in FIG. 4, each journal member 24 of each mandrel assembly 23 has a rearward projection 36, the rear end of which is pivoted to a pivot joint 37 on a transversely extending shaft 38. As shown in FIGS. 2 and 3, the left hand end of the shaft 38 mounts a cam follower roller 39 engaged in a generally vertically extending cam track 40. A further roller 41 coupled to the upper portion 21 runs in a vertically extending guide track 42. The cam track 42 is linear but the cam track 40, over the range A (FIG. 2) is offset by an amount B such that as the roller 39 traverses the portion A, when the upper bolster 16 is raised by the piston-cylinder arrangement 18, the shaft 38 will be moved axially by the distance B. The arms 36 engaged with the shaft 38 will then cause the upper journals 24 of the mandrel assemblies 23 to be rotated on the bearings 25 and 26 with respect to the upper housing member 21. In the embodiment shown the rotation is through an angle of 12° to cause the mandrel 28 and the sleeve assembly 29 to rotate to free the sleeve assembly 29 and the mandrel 28 from the molded member although leaving the mandrel 28 projecting into the molded member and leaving the molded member secured to the end surface of the tube 30, which surface is preferably roughened to firmly grip the molded member. When, in the upward movement of the upper bolster 16, the rods 35 abut the adjustable stops 19 and 20, the lower housing portion 31 is prevented from moving further upwardly and continued upward movement of the upper housing portion 21 causes the pistons 33 to move downwardly in the cylinders 34 further to compress the air therein. The tubes 30 are secured to the lower housing portion 31 and thus, as the lower housing portion 31 is checked while the upper housing portion 21 continues to move upwardly, the tubes 30 slide downwardly over the mandrels 28, thereby sliding the molded bodies down over the mandrels 28 to withdraw the mandrels 28 from within the molded bodies. The length of the push-off stroke P (FIG. 1) of the lower housing portion 31 with respect to the upper housing portion 21 is adjustable by adjusting the position of the stops 19, 20. Ejectors, not shown, are then caused to engage the molded bodies to disengage the molded bodies from the lower ends of the tubes 30 and transfer them to a conveyor for further processing.

Figure 5:
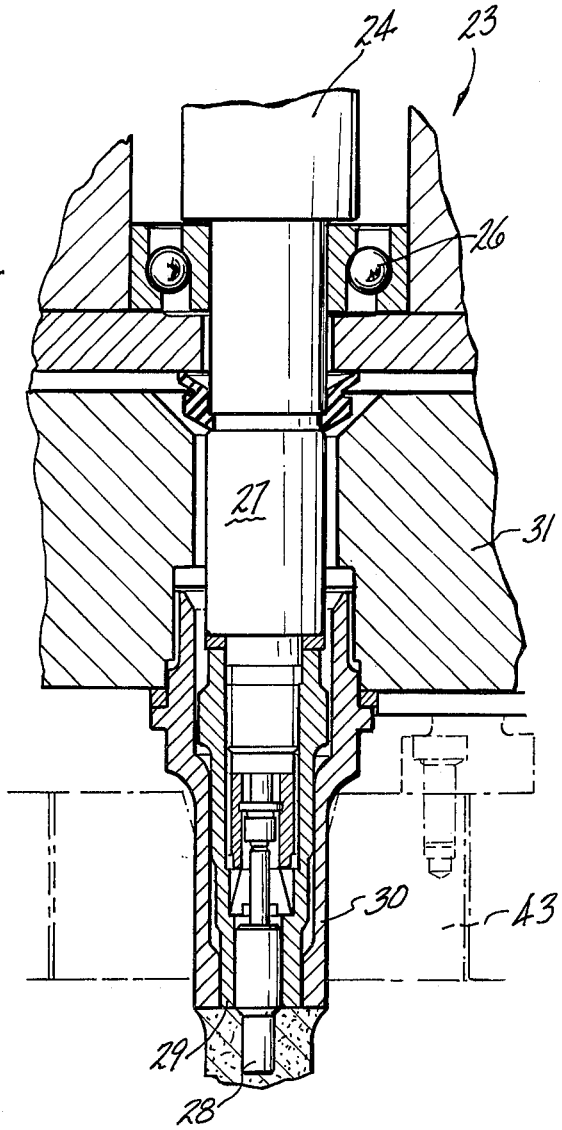
FIG. 5 is a fragmentary elevation of the molding assembly portion of FIG. 2.

After the upper housing portion 21 has moved to the top of its stroke and started downwardly again, the compressed air in the cylinders 34 ensures that, as soon as the rods 35 disengage from the adjustable stops 19 and 20, the lower housing portion 31 will be brought into close proximity with the upper housing portion 21 to restore the tubes 30 to the positions relative to the respective sleeve assembly 29 and the mandrel 28 shown in FIG. 5 for a further molding operation.

Caps 43 (FIG. 1) provided on the lower bolster 10 include means (not shown) whereby they can be coupled to a powder dispenser to fill powder into the molds provided in the lower bolster 10. The caps 43 are shown also in FIG. 2 in which the upper bolster 16 is shown in its lower portion, but are not otherwise relevant to the invention. By properly positioning the offset portion A of the cam track 40, the twisting motion of the mandrels 28 and sleeve assemblies 29 can be timed to occur as the mandrels 28 are being withdrawn from the molded bodies due to the movement apart of the upper housing portion 21 and the lower housing portion 31.

Figure 6:
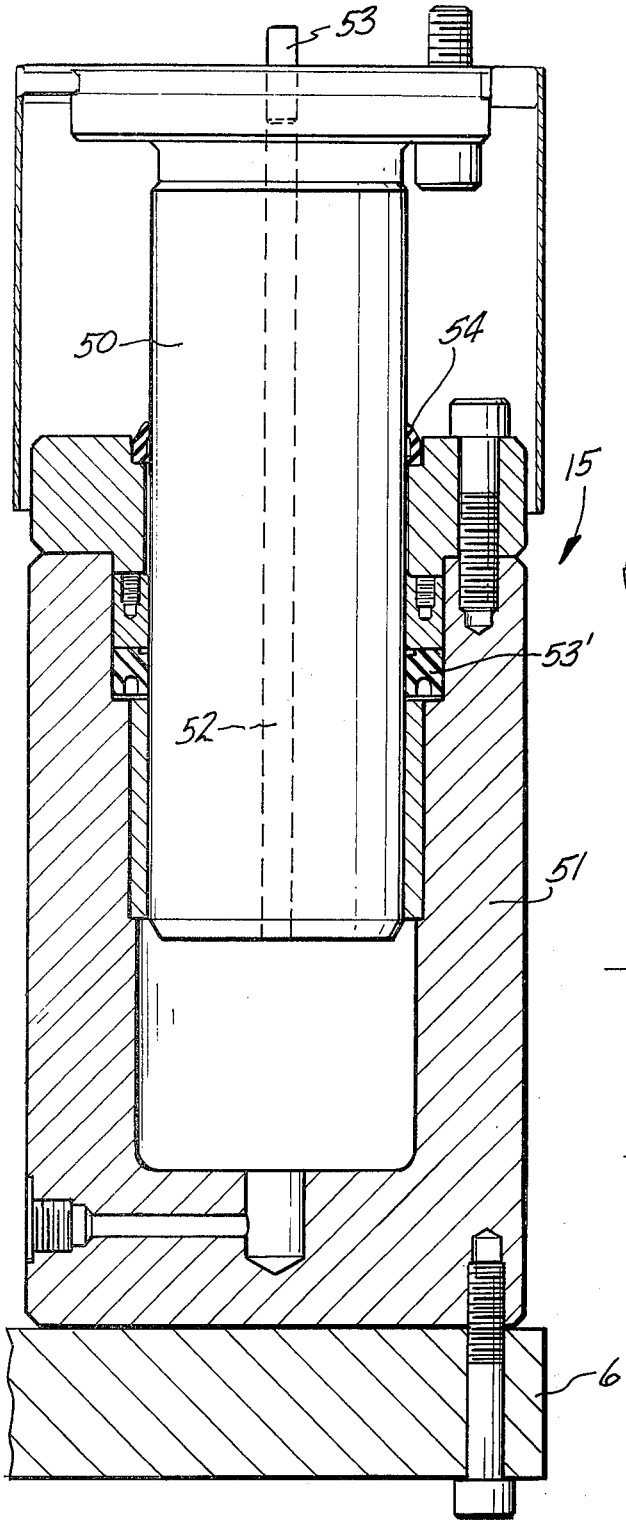
FIG. 6 is a sectional view through the pressure intensifier of the isostatic molding apparatus shown in FIG. 1.

FIG. 6 shows the pressure intensifier 15 of FIG. 1 and shows that it comprises a plunger 50, the upper end of which is secured to the underside of the lower bolster 10, and a cylinder 51, the lower end of which is secured to the upper side of the rigid cross member 6. When a molding operation is to be effected, the upper bolster 16 is moved downwardly by the piston-cylinder arrangement 18 to insert the mandrels 28 into the molds in the lower bolster 10, continued downward movement of the upper bolster 16 moving the lower bolster 10 downwardly also to displace the piston 50 downwardly in the cylinder 51 thereby causing pressure fluid contained in the cylinder 51 below the piston 50 to be forced upwardly through a bore 52 in the piston 50 and through a connecting pipe 53 into the lower bolster 10 to act on flexible molds contained in the lower bolster 10 to compress powder in the molds in the manner described in British patent specification No. 1,383,395. As the lower bolster 10 moves downwardly from the position shown in FIG. 1 the rods 11 and 12 are slid downwardly through the bores in the rigid cross member 6 to cause the cross member 13 to compress the air spring 14. Following the molding operation, and upon upward movement of the upper bolster 16 by the piston-cylinder arrangement 18, the lower bolster 10 follows such movement due to the pressure in the air spring 14 acting through the rods 11 and 12. When the cross member 13 moves into abutment with the underside of the cross member 6 forming the upper member of the rigid pedestal 7 which supports the cylinder 51 of the intensifier 15, the lower bolster 10 is checked and the upper bolster 16 continues to move on upwardly thereby separating it from the lower bolster member 10. The separation of the pressure intensifier 15 from the air spring 14, compared with the construction shown in British patent specification No. 1,383,395, has the advantages:

a. That there is no risk of compressed air entering the hydraulic system of the pressure intensifier 15;

b. Maintenance is easier;

c. Any contaminant in the fluid sinks to the bottom of the cylinder 51 thus keeping the area of a seal 53' free from potential damage;

d. Risk of drawing in air past a wiper seal 54 is reduced because as the piston 50 is pushed in the cylinder 51, a pressure is immediately created. This counteracts the tendency to draw in air past the seal due to a natural pumping action. When the piston is withdrawn, the pumping action is created on the fluid side which will tend to improve the sealing action — since this type of seal works best under slight pressure;

e. The wiper seal 54 preferably has a lip construction which also helps to reduce the risk of drawing in air.

Air contamination and fluid leakage can be a problem in such pressure intensifiers since the fluid is contained in a relatively low volume closed vessel. The system is thus sensitive to small leaks of fluid and air out of, or into, the system.

FIG. 1 shows an air bleed arrangement for the hydraulics of the pressure intensifier 15. A pipe 55 is connected to the bottom of the cylinder 51 and leads, via a shut-off valve 56, to a translucent hydraulic pressure fluid reservoir 57. A bleed valve 58, comprising a ball pressed onto a seating by a screw with a flat thereon or an aperture therethrough, is provided in the lower bolster 10 adjacent each mold therein. To purge the hydraulic system of the pressure intensifier 15 of air and top it up with hydraulic fluid, the lower bolster is raised fully up against the stops located in the cross member 13, the shut off valve 56 is opened fully and the bleed screws 50 are slackened off one at a time until fluid discharges from then in a countinuous stream under the head h of hydraulic fluid provided by the reservoir 57. The bleed screws 58 are tightened and finally the shut off valve 56 is closed. The air spring 14 can, for example, be of the type sold by Firestone under the reference "Airstroke Number 25".

Since many changes and variations of the disclosed embodiment of the invention may be made without departing from the inventive concept, it is not intended to limit the invention otherwise than as required by the appended claims.

What is claimed is:

1. An isostatic pressure molding apparatus comprising:

a. a fixed frame b. a first bolster assembly slidably mounted on said frame, said first bolster assembly housing at least one mold to which fluid pressure is applied to compact powder disposed therein into a coherant body;

c. a piston mounted on said first bolster assembly and movable therewith, said piston having a passage through which pressure fluid flows to said mold;

d. a pressure fluid reservoir mounted on said frame, said piston extending into said reservoir so that movement of said first bolster assembly in a first direction results in said piston being moved further into said reservoir to cause the fluid therein to flow through said piston passage to said mold; and e. spring means mounted on said frame separate from said pressure fluid reservoir, means connecting said spring means with said first bolster assembly, said spring means being separable to return said first bolster assembly in a direction opposite to said first direction upon completion of a pressing operation.

2. The apparatus of claim 1, further comprising a second bolster assembly movably mounted on said frame and having mounted thereon mold closing means and mandrel means which extend into said mold during the pressing operation; actuating means on said frame connected to said second bolster assembly for moving the latter toward and against said first bolster assembly, said actuating means being operable to move both of said bolster assemblies in said first direction to actuate said pressure fluid reservoir during the molding operation; and said actuating means being operable to move said second bolster assembly away from said first bolster assembly to open said mold after the molding operation.

3. The apparatus of claim 2, wherein said mandrel means is rotatably journaled in said second bolster assembly and further comprising means mounted on said second bolster assembly operable, when the latter is moved away from said first bolster assembly, to rotate said mandrel means to free the latter from adherance to a compacted powder body.

4. The apparatus of claim 3, wherein said second bolster assembly is divided into an upper housing and a lower housing, said upper and lower housings being juxtaposed when said second bolster assembly engages said first bolster assembly during a molding operation; means for separating said upper housing from said lower housing when said mold is opened after a molding operation; said mandrel means being journaled to said upper housing and extending through and depending from said lower housing; a sleeve encircling said mandrel, said sleeve being connected to said upper housing; and a tube encircling said sleeve, said tube being connected to said lower housing, said tube being operable to slide over said sleeve and mandrel when said upper housing is separated from said lower housing to push a compacted powder body out of engagement with said sleeve and mandrel.

5. An isostatic pressure molding apparatus having a mold in which powder is compacted into a coherant body, said apparatus comprising a movable bolster having mold closing means for closing and opening said mold in response to appropriate movement of said bolster, said bolster being sub-divided into an upper housing and a lower housing, said housing being juxtaposed when said bolster closes said mold, and said housings being separated when said bolster opens said mold; a mandrel assembly mounted on said upper housing and extending through said lower housing to project therebeyond when said mold is closed, said mandrel assembly including a mandrel which extends into said mold when the latter is closed and onto which mandrel the compacted powder body is pressed; and a sleeve surrounding said mandrel and connected to said upper housing, said sleeve forming a part of said mold closing means; a tube surrounding said sleeve and mounted on said lower housing, said tube forming the outermost part of said mold closing means whereby the compacted powder body is pressed into adherance with said sleeve and tube during the pressing operation; said tube being operable to push the compacted powder body off of said sleeve and mandrel after the mold is opened by reason of the separation of said upper housing from said lower housing when said bolster opens said mold.

6. The apparatus of claim 5, wherein said mandrel assembly is rotatably journaled in said upper housing; and further comprising means for rotating said mandrel assembly responsive to separation of said upper and lower housings.

* * * * *